US008893633B2

(12) United States Patent
Tokura

(10) Patent No.: US 8,893,633 B2
(45) Date of Patent: Nov. 25, 2014

(54) SEWING MACHINE AND NON-TRANSITORY COMPUTER-READABLE MEDIUM STORING SEWING MACHINE CONTROL PROGRAM

(75) Inventor: Masashi Tokura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 678 days.

(21) Appl. No.: 13/213,746

(22) Filed: Aug. 19, 2011

(65) Prior Publication Data

US 2012/0048163 A1 Mar. 1, 2012

(30) Foreign Application Priority Data

Aug. 24, 2010 (JP) ..... 2010-186852

(51) Int. Cl.

| | |
|---|---|
| ***D05B 19/00*** | (2006.01) |
| ***D05B 3/06*** | (2006.01) |
| ***D05B 19/14*** | (2006.01) |
| ***D05B 29/08*** | (2006.01) |
| ***D05B 69/26*** | (2006.01) |

(52) U.S. Cl.

CPC *D05B 3/06* (2013.01); *D05B 19/14* (2013.01); *D05B 29/08* (2013.01); *D05B 69/26* (2013.01)

USPC ..... 112/447; 112/470.01; 700/136

(58) Field of Classification Search

CPC ..... D05B 3/06; D05B 3/08; D05B 69/14; D05B 69/18; D05B 69/20; D05B 19/10; D05B 19/12; D05B 19/14; D05C 5/02

USPC ..... 112/102.5, 151, 446, 447, 470.01, 112/470.03–470.06, 475.17, 475.25

See application file for complete search history.

(56) References Cited

U.S. PATENT DOCUMENTS

| | | | | |
|---|---|---|---|---|
| 6,450,110 | B1 * | 9/2002 | Bruhl et al. | 112/470.01 |
| 6,883,446 | B2 * | 4/2005 | Koerner | 112/272 |
| 6,959,657 | B1 * | 11/2005 | Duval | 112/272 |
| 7,299,757 | B2 | 11/2007 | Niizeki et al. | |
| 7,325,502 | B2 * | 2/2008 | Konig et al. | 112/475.02 |
| 2007/0005175 | A1 | 1/2007 | Konig et al. | |
| 2009/0188413 | A1 | 7/2009 | Hirata et al. | |
| 2009/0312861 | A1 | 12/2009 | Hirose et al. | |

FOREIGN PATENT DOCUMENTS

| | | |
|---|---|---|
| EP | 0 103 364 A2 | 3/1984 |
| JP | A-58-027589 | 2/1983 |

(Continued)

OTHER PUBLICATIONS

Feb. 1, 2012 Extended Search Report issued in European Patent Application No. 11178525.9.

*Primary Examiner* — Nathan Durham
(74) *Attorney, Agent, or Firm* — Oliff PLC

(57) ABSTRACT

A sewing machine includes a needle bar, a sewing machine motor, an acquisition portion that acquires a reference length, an image capture portion that generates image data by image capture of one of the sewing object and at least one marker, a computation portion that computes an amount of movement of one of the sewing object and the at least one marker, a speed control portion that sets a revolution speed of the sewing machine motor to not greater than a specified value in a case where it is determined that sewing is being performed in a specified range, and a sewing control portion that terminates the sewing of the stitch portion in a case where it is determined that a length that has been sewn in the reference direction of the stitch portion is not less than the reference length.

8 Claims, 15 Drawing Sheets

(56) References Cited

FOREIGN PATENT DOCUMENTS

| | | |
|---|---|---|
| JP | A-59-062083 | 4/1984 |
| JP | A-60-111685 | 6/1985 |
| JP | A-09-187586 | 7/1997 |
| JP | A-2006-346087 | 12/2006 |
| JP | A-2009-172123 | 8/2009 |
| JP | A-2009-297190 | 12/2009 |

* cited by examiner

FIG. 6

600

| DATA NUMBER | FEED AMOUNT | SWING AMOUNT | LOOP FLAG |
|---|---|---|---|
| 1 | 0 | 150 | 0 |
| 2 | 0 | 0 | 0 |
| 3 | -108 | -175 | 0 |
| 4 | -90 | -175 | 1 |
| 5 | -90 | -175 | 2 |
| 6 | 0 | -150 | 0 |
| 7 | 90 | -150 | 1 |
| 8 | 90 | -150 | 2 |
| 9 | -36 | -50 | 0 |
| 10 | 216 | 0 | 0 |
| 11 | -216 | -25 | 0 |
| 12 | 198 | -100 | 0 |
| 13 | -198 | -50 | 0 |
| 14 | 126 | -175 | 0 |
| 15 | -162 | -50 | 0 |
| 16 | 72 | -225 | 0 |
| 17 | -108 | -50 | 0 |
| 18 | 0 | -250 | 0 |
| 19 | -54 | -50 | 0 |
| 20 | -54 | -250 | 1 |
| 21 | -54 | -50 | 2 |
| 22 | 0 | 150 | 0 |
| 23 | 90 | 150 | 1 |
| 24 | 90 | 150 | 2 |
| 25 | -36 | 50 | 0 |
| 26 | 216 | 0 | 0 |
| ⋮ | ⋮ | ⋮ | ⋮ |

FIG. 7

600

| DATA NUMBER | FEED AMOUNT | SWING AMOUNT | LOOP FLAG |
|---|---|---|---|
| ⋮ | ⋮ | ⋮ | ⋮ |
| 27 | -216 | 25 | 0 |
| 28 | 198 | 100 | 0 |
| 29 | -198 | 50 | 0 |
| 30 | 126 | 175 | 0 |
| 31 | -162 | 50 | 0 |
| 32 | 72 | 225 | 0 |
| 33 | -108 | 50 | 0 |
| 34 | 0 | 250 | 0 |
| 35 | -54 | 50 | 0 |
| 36 | -54 | 250 | 1 |
| 37 | -54 | 50 | 2 |
| 38 | -72 | -250 | 0 |
| 39 | 18 | 250 | 0 |
| 40 | 36 | -250 | 0 |
| 41 | 36 | 250 | 0 |
| 42 | 36 | -250 | 0 |
| 43 | 36 | 250 | 0 |
| 44 | 0 | -250 | 0 |
| 45 | -36 | -250 | 0 |
| 46 | -36 | -250 | 0 |
| 47 | 108 | -250 | 0 |

FIG. 12

| POINTER | | COORDINATES ON SEWING OBJECT | |
|---|---|---|---|
| P1 | P2 | Y COORDINATE | X COORDINATE |
| 1 | 0 | 0 | 150 |
| 2 | 0 | 0 | 0 |
| 3 | 0 | 108 | -175 |
| 4 | 4 | 198 | -175 |
| 5 | 4 | 288 | -175 |
| 4 | 4 | 378 | -175 |
| 5 | 4 | 468 | -175 |
| 4 | 4 | 558 | -175 |
| 5 | 4 | 648 | -175 |
| 4 | 4 | 738 | -175 |
| 5 | 4 | 828 | -175 |
| 4 | 4 | 918 | -175 |
| 5 | 4 | 1008 | -175 |
| 4 | 4 | 1098 | -175 |
| 5 | 4 | 1188 | -175 |
| 4 | 4 | 1278 | -175 |
| 5 | 4 | 1368 | -175 |
| 4 | 4 | 1458 | -175 |
| 5 | 4 | 1548 | -175 |
| 4 | 4 | 1638 | -175 |
| 5 | 4 | 1728 | -175 |
| 4 | 4 | 1818 | -175 |
| 5 | 4 | 1908 | -175 |
| ⋮ | ⋮ | ⋮ | ⋮ |

SEWING MACHINE AND NON-TRANSITORY COMPUTER-READABLE MEDIUM STORING SEWING MACHINE CONTROL PROGRAM

CROSS-REFERENCE TO RELATED APPLICATION

This application claims priority to Japanese Patent Application No. 2010-186852, filed Aug. 24, 2010, the content of which is hereby incorporated herein by reference.

BACKGROUND

The present disclosure relates to a sewing machine includes an image capture portion and to a non-transitory computer-readable medium that stores a sewing machine control program.

A sewing machine is known that can automatically sew a buttonhole stitch in a sewing object (for example, a work cloth). There are various types of buttonhole stitches, such as a double bar tack buttonhole, a round ended buttonhole, and an eyelet buttonhole. A buttonhole stitch includes a pair of whipstitch portions that extend in the direction of the length of the buttonhole and another stitch portion according to the type of the buttonhole. The other stitch portions may be a bar tack stitch portion, a loop stitch portion, or the like, for example. The sewing machine may form the buttonhole stitch by varying a feed amount and a swing width as the sewing machine performs the sewing. The feed amount is the amount that the sewing object is moved in one of a forward direction and a rearward direction by a feed dog. The swing width is the amount that the needle bar is moved in the left-right direction. The sewing machine may vary the length of the pair of whipstitch portions as necessary according to the size (diameter) of the button. Specifically, a length of a portion that forms the buttonhole stitch may be adjusted in accordance with the length of the pair of whipstitch portions. Accordingly, a sewing machine has been proposed in which the revolution speed of the sewing machine motor is decelerated before the stitching direction (the feed direction) for the whipstitch portions of the buttonhole stitch is switched.

SUMMARY

In the known sewing machine, the revolution speed of the sewing machine motor may be decelerated in accordance with the number of stitches (the number of needle drop points) in the whipstitch portions of the buttonhole stitch. With the known sewing machine, the user may be unable to confirm whether a buttonhole stitch of the specified size has been accurately stitched until the sewing is completed. For example, in a case where the revolution speed of the sewing machine motor is high, the feed amount may become a little too large, due to the inertial force of the feed mechanism that drives the feed dog, such that the buttonhole stitch may not be sewn to the specified size. The buttonhole may not be sewn to the specified size in a case where the sewing object contracts due to thread tension.

Various exemplary embodiments of the broad principles derived herein provide a sewing machine and a non-transitory computer-readable medium that stores a sewing machine control program that are capable of accurately forming a stitch portion of a specified length.

Exemplary embodiments provide a sewing machine that includes a needle bar, a sewing machine motor that drives the needle bar up and down, an acquisition portion that acquires a reference length that is a length of a stitch portion in a reference direction, the stitch portion being at least one part of a stitch set that is to be sewn on a sewing object, an image capture portion that generates image data by image capture of one of the sewing object and at least one marker that is moved together with the sewing object, and a computation portion that computes an amount of movement of one of the sewing object and the at least one marker, based on at least the image data that have been generated by the image capture portion. The sewing machine also includes a speed control portion that sets a revolution speed of the sewing machine motor to not greater than a specified value in a case where it is determined, based on the amount of movement that has been computed by the computation portion, that sewing is being performed in a specified range that has been set at an opposite side of the stitch portion from a starting point of the stitch portion in the reference direction, and a sewing control portion that terminates the sewing of the stitch portion in a case where it is determined, based on the amount of movement that has been computed by the computation portion, that a length that has been sewn in the reference direction of the stitch portion is not less than the reference length that was acquired by the acquisition portion.

Exemplary embodiments also provide a non-transitory computer-readable medium storing a control program executable on a sewing machine. The program includes instructions that cause a computer of the sewing machine to perform the steps of acquiring a reference length that is a length of a stitch portion in a reference direction, the stitch portion being at least one part of a stitch set that is to be sewn on a sewing object, generating image data by image capture of one of the sewing object and at least one marker that is moved together with the sewing object, computing an amount of movement of one of the sewing object and the at least one marker, based on at least the image data, setting a revolution speed of a sewing machine motor to not greater than a specified value in a case where it is determined, based on the amount of movement, that sewing is being performed in a specified range that has been set at an opposite side of the stitch portion from a starting point of the stitch portion in the reference direction, the sewing machine motor driving a needle bar up and down, and terminating the sewing of the stitch portion in a case where it is determined, based on the amount of movement, that a length that has been sewn in the reference direction of the stitch portion is not less than the reference length.

BRIEF DESCRIPTION OF THE DRAWINGS

Exemplary embodiments will be described below in detail with reference to the accompanying drawings in which:

FIG. 6 is an explanatory figure of a portion of sewing data 600 for sewing a buttonhole stitch;

FIG. 7 is an explanatory figure of another portion of the sewing data 600 for sewing a buttonhole stitch;

FIG. 12 is an explanatory figure for explaining correspondences among a first pointer P1, a second pointer P2, and a position of a needle drop point;

DETAILED DESCRIPTION

Hereinafter, a sewing machine 1 according to an embodiment will be explained with reference to the drawings.

The physical configuration of the sewing machine 1 will be explained with reference to FIGS. 1 to 4. In the explanation that follows, the lower left side, the upper right side, the upper left side, and the lower right side of the page of FIG. 1 respectively correspond to the left, the right, the rear, and the front of the sewing machine 1.

Figure 1:
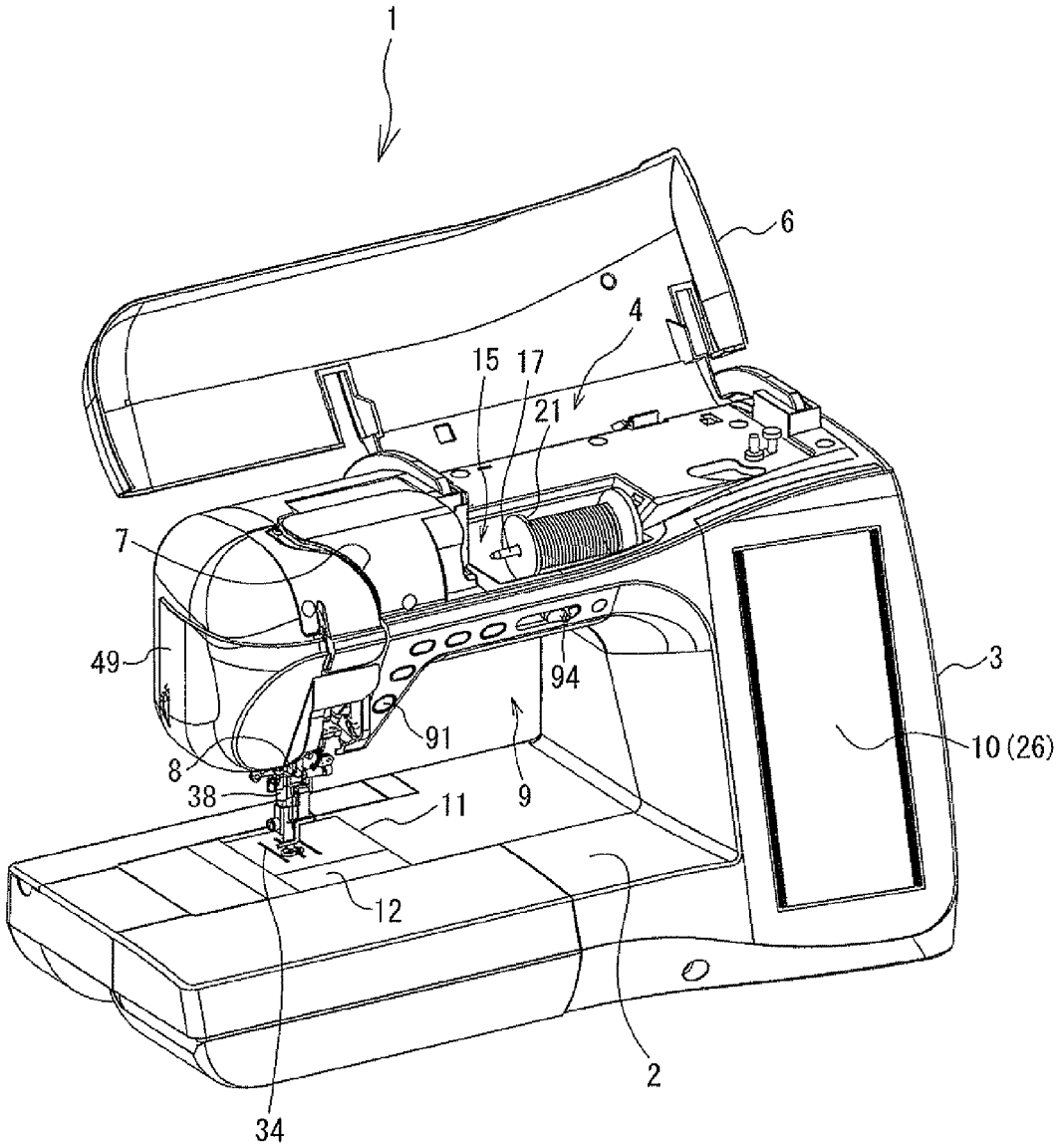
FIG. 1 is an oblique view of a sewing machine 1.

As shown in FIG. 1, the sewing machine 1 includes a bed 2, a pillar 3, and an arm 4. The pillar 3 is erected upward at the right end of the bed 2. The arm 4 extends leftward from the upper end of the pillar 3 so as to face to the bed 2. A head 49 is provided in the left end portion of the arm 4.

A needle plate 11 is provided in the bed 2. A rectangle hole 34 is formed in the needle plate 11. A feed dog (not shown in the drawings) may protrude from the rectangle hole 34. A shuttle mechanism (not shown in the drawings), the feed dog, and a feed mechanism (not shown in the drawings) are provided inside the bed 2 underneath the needle plate 11. A lower thread bobbin (not shown in the drawings) is contained within the shuttle mechanism. The feed dog moves a sewing object (for example, a work cloth) by a specified feed amount. The feed mechanism uses a feed adjustment motor 201 (refer to FIG. 5) as a drive source to drive the feed dog. For example, Japanese Laid-Open Patent Publication No. 2006-346087 discloses the feed mechanism, the relevant portions of which are incorporated by reference.

A sewing machine motor 79 (refer to FIG. 5) is provided in the lower portion of the pillar 3. The drive power from the sewing machine motor 79 is transmitted via a drive belt (not shown in the drawings) to a drive shaft 51 (refer to FIG. 3). The drive shaft 51 extends in right-left direction in the arm 4. The drive power from the sewing machine motor 79 is also transmitted via a transmission mechanism (not shown in the drawings) to a lower shaft (not shown in the drawings). The transmission mechanism is provided on the drive shaft 51. The lower shaft extends in right-left direction in the bed 2. The aforementioned configuration enables a needle bar 8, which is described below, a thread take-up mechanism (not shown in the drawings), the shuttle mechanism (not shown in the drawings), the feed dog, and the like to be driven in synchronization.

As shown in FIG. 1, the pillar 3 is provided with a vertically long liquid crystal display (LCD) 10. Various messages and function names to perform various functions necessary in sewing, such as setting and editing of a pattern, and the like may be displayed on the LCD 10. A touch panel 26 (refer to FIG. 5) is provided on a surface of the LCD 10. In a case where an item displayed on the LCD 10 is selected with a finger of the user or a dedicated pen, the selection of the item is detected by the touch panel 26. Thus, the user can enter various instructions using the LCD 10 and the touch panel 26.

A holder 15 is provided in an upper portion of the arm 4. The holder 15 is a recessed portion, which accommodates a spool 21 on which an upper thread is wound. The needle bar 8 is provided to the bottom of the head 49. A needle 16 (refer to FIG. 2) can be attached to the lower end of the needle bar 8. A needle bar up-down moving mechanism 55 (refer to FIG. 3), a needle bar swinging mechanism 59 (refer to FIG. 3), and the thread take-up lever mechanism (not shown in the drawings) are provided inside the head 49. The needle bar up-down moving mechanism 55 drives the needle bar 8 to which the needle 16 is attached up and down. The needle bar swinging mechanism 59 swings the needle bar 8 to the left and the right.

The arm 4 is provided with a thread guide groove 7. The thread guide groove 7 leads an upper thread that is pulled from the spool 21 to a needle 16 via a tensioner, a thread take-up spring, and a thread take-up lever, and the like, which are not shown in the drawings. A plurality of operation keys 9 are provided on a front surface of the arm 4. The plurality of operation keys 9 are used for instructions of various sewing operations. The plurality of operation keys 9 include a sewing start/stop switch 91 and a speed controller 94, for example. The sewing start/stop switch 91 is used for issuing a command to start or stop sewing. The speed controller 94 is used for controlling the sewing speed (the revolution speed of the sewing machine motor 79).

Figure 2:
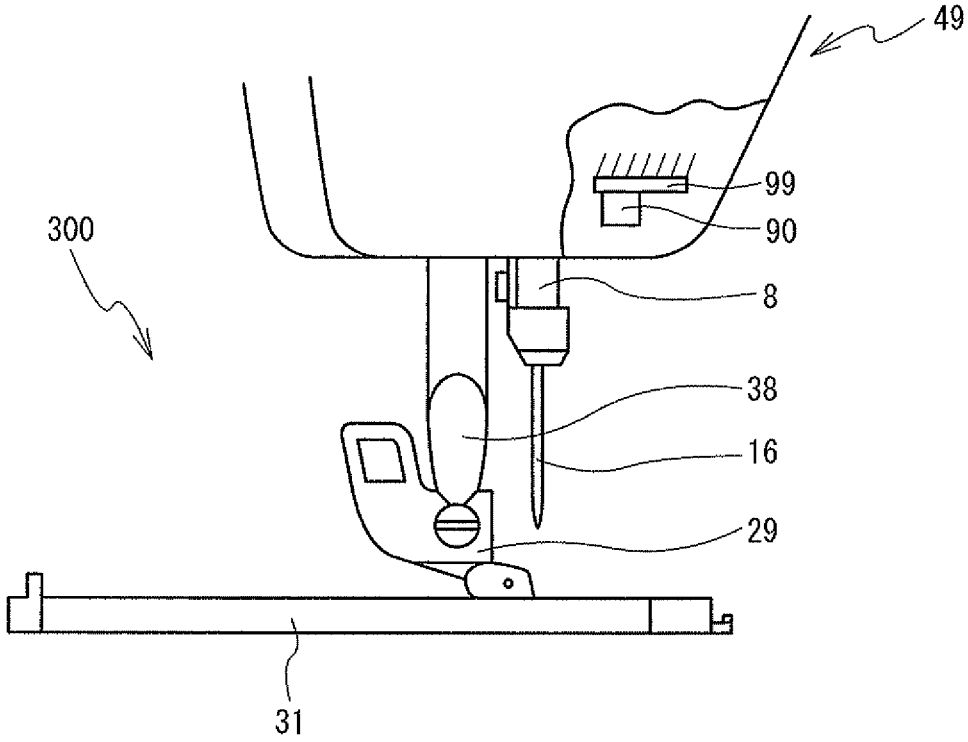
FIG. 2 is a left side view of a main portion of a head 49.

As shown in FIG. 2, a presser bar 38 is provided to the rear of the needle bar 8. A presser holder 29 can be attached to the lower end of the presser bar 38. A presser 300 for buttonhole stitching can be attached to and detached from the presser holder 29. Hereinafter, the presser 300 for buttonhole stitching is referred to as the presser 300. The presser 300 will be described in detail below. An image sensor 90 is attached to the head 49 in front of the needle bar 8 and slightly to the right of the needle bar 8 in a front view. The image sensor 90 is attached such that the image sensor 90 can capture an image of the entire needle plate 11. The image sensor 90 includes a complementary metal-oxide semiconductor (CMOS) sensor and a control circuit. The image sensor 90 generates image data that describe the image that is captured by the CMOS sensor. In the present embodiment, a support frame 99 is attached to a machine casing (not shown in the drawings) of the sewing machine 1, as shown in FIG. 2. The image sensor 90 is affixed to the support frame 99.

Figure 3:
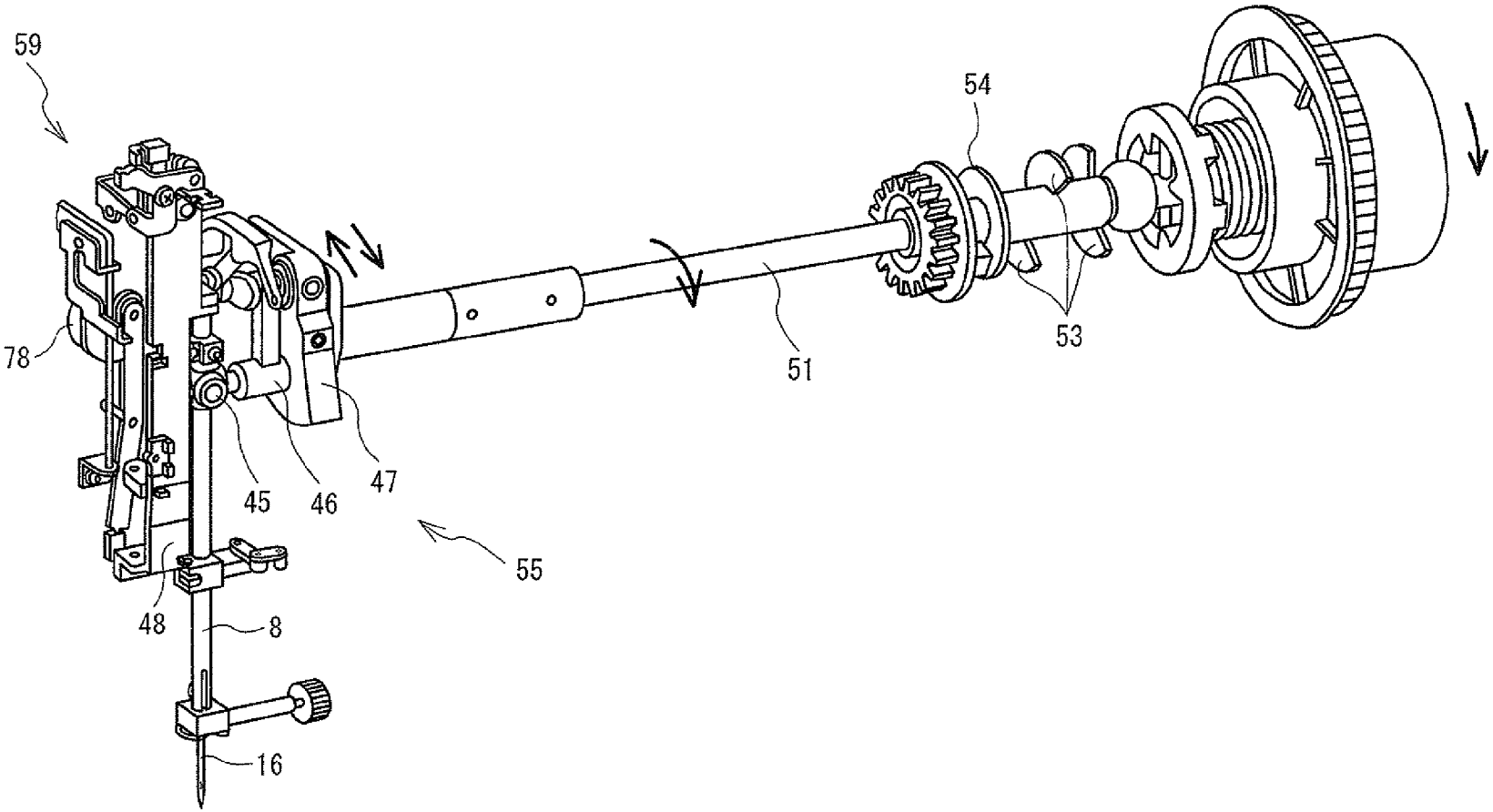
FIG. 3 is an oblique view of a needle bar up-down moving mechanism 55.

The needle bar up-down moving mechanism 55 and the needle bar swinging mechanism 59 will be explained with reference to FIG. 3. As shown in FIG. 3, the needle bar up-down moving mechanism 55 includes the drive shaft 51, a thread take-up lever crank 47, a needle bar crank rod 46, and a needle bar holder 45. The left end of the drive shaft 51 is affixed to the right side face of the thread take-up lever crank 47. The upper end of the needle bar crank rod 46 is rotatably coupled to the left side face of the thread take-up lever crank 47. The needle bar holder 45 is affixed to the needle bar 8 and is coupled to the lower end of the needle bar crank rod 46 such that the needle bar holder 45 can swing. The needle bar 8 is supported by a needle bar base 48 such that the needle bar 8 can slide up and down. The upper end of the needle bar base 48 is pivotally supported by the sewing casing (not shown in the drawings) such that the needle bar base 48 can swing to the right and the left. The needle bar 8 is moved up and down by the needle bar up-and-down moving mechanism 55 as hereinafter described. When the drive shaft 51 is rotated by the operation of the sewing machine motor 79 (refer to FIG. 5), the rotational motion of the drive shaft 51 is transmitted as an up-down motion to the needle bar holder 45 through the thread take-up lever crank 47 and the needle bar crank rod 46. The up-down motion of the needle bar holder 45 is transmitted to the needle bar 8, so that the needle bar 8 can be moved up and down.

The needle bar swinging mechanism 59 is a known mechanism for moving the needle bar 8 in the left-right direction. Although the details are not shown in the drawings, the needle bar swinging mechanism 59 causes the needle bar base 48 to swing in the left-right direction by driving an eccentric swinging cam (not shown in the drawings). The swinging cam rotates by using a needle bar swinging motor 78 as a drive source. The swinging of the needle bar base 48 in the left-right direction causes the needle bar 8 to swing in the left-right direction.

A mechanism in which a drive shaft angle sensor 32 (refer to FIG. 5) detects the angle of rotation of the drive shaft 51 will be explained with reference to FIG. 3. As shown in FIG. 3, rotating shutters 53 and an encoder disk 54 are provided on the drive shaft 51. The rotating shutters 53 include a plurality of fan-shaped shielding plates. A plurality of tiny slits are formed in the encoder disk 54. The drive shaft angle sensor 32 is provided in the machine casing (not shown in the drawings). The drive shaft angle sensor 32 optically detects the rotation of the rotating shutters 53 and the encoder disk 54. The position of the needle bar 8 in the up-down direction is determined based on the angle of rotation of the drive shaft 51 that is detected by the drive shaft angle sensor 32. A single stitch is formed when the drive shaft 51 completes one revolution. The sewing machine 1 is therefore able to detect that a single stitch has been formed by continuously detecting the angle of rotation of the drive shaft 51 using the drive shaft angle sensor 32.

The presser 300 will be explained with reference to FIGS. 2 and 4. The bottom and the top of the page of FIG. 4 respectively correspond to the front and the rear of the presser 300. As will be described below, the presser 300 is a presser foot that is used for darning stitching and bar tack stitching, in addition to buttonhole stitching. The presser 300 includes a presser portion 31 and a support portion 36. The presser portion 31 may press down on the sewing object around the portion where the stitch will be formed. In a plan view, the presser portion 31 has a roughly rectangular shape that is long and narrow. The presser portion 31 includes an opening 319. The presser portion 31 is supported by the support portion 36 such that the presser portion 31 can slide in the front-rear direction in relation to the support portion 36. A needle drop hole 369 is provided in the center of the support portion 36. The front end of the opening 319 extends as far as the needle drop hole 369. During the sewing, the needle 16 may pass through the needle drop hole 369 and the opening 319. In a case where the presser 300 is used, the stitch is formed on the inner side of the opening 319.

A spiral spring is contained within the front end of the presser portion 31, although it is not shown in the drawings. An end of the spiral spring is affixed to the front end of the support portion 36. Therefore, when the sewing starts, the spring force of the spiral spring causes the support portion 36 to be in an initial position at the front end of the range within which the support portion 36 can slide, as shown in FIG. 4. The spring force of the spiral spring is set to be weak, such that the spiral force does not affect the sewing of the buttonhole stitch. An anti-slip sheet is affixed to the underside (the bottom face) of the presser portion 31, although this is not shown in the drawings. The anti-slip sheet is made of rubber and may prevent slippage in relation to the sewing object. Therefore, in a case where the sewing object is moved by the feed dog (not shown in the drawings), the presser portion 31 to which the anti-slip sheet is affixed slides in relation to the support portion 36, such that the presser portion 31 is moved together with the sewing object. The presser 300 is mounted on the presser holder 29 by removably engaging a mounting pin 361 that is provided in the support portion 36 with the presser holder 29, which is attached to the presser bar 38.

The right portion of the presser portion 31 is a marker positioning portion 321. Markers 322 to 324 are disposed on the top face of the marker positioning portion 321. The markers 322 to 324 are used in computing an amount of movement of the sewing object based on the image data that are generated by the image sensor 90. As described above, the presser portion 31 is moved together with the sewing object. Therefore, the amount of movement of the sewing object is equal to the amount of movement of each of the markers 322 to 324. In the sewing machine 1 according to the present embodiment, the amount of movement of the sewing object is expressed by the amount of movement of the marker 322. Each of the markers 322 to 324 is a marker that is a combination of a circle 341 and a center 342 of the circle 341. The color of the circle 341 may be black, for example. The color of the center 342 may be red, for example. In the process of the sewing, the markers 322 to 324 are positioned such that at least one of the markers 322 to 324 is located within an image capture area 380 of the image sensor 90. Specifically, a length 330 from the front edge of the marker 322 to the rear edge of the marker 323 is shorter than a length 382 in the front-rear direction of the image capture area 380 of the image sensor 90. The image capture area 380 of the image sensor 90 is an area on the surface of the sewing object that is disposed on the bed 2. In the same manner, a length 331 from the front edge of the marker 323 to the rear edge of the marker 324 is shorter than the length 382 in the front-rear direction of the image capture area 380 of the image sensor 90. An interval 332 between adjacent markers is approximately five centimeters.

Figure 5:
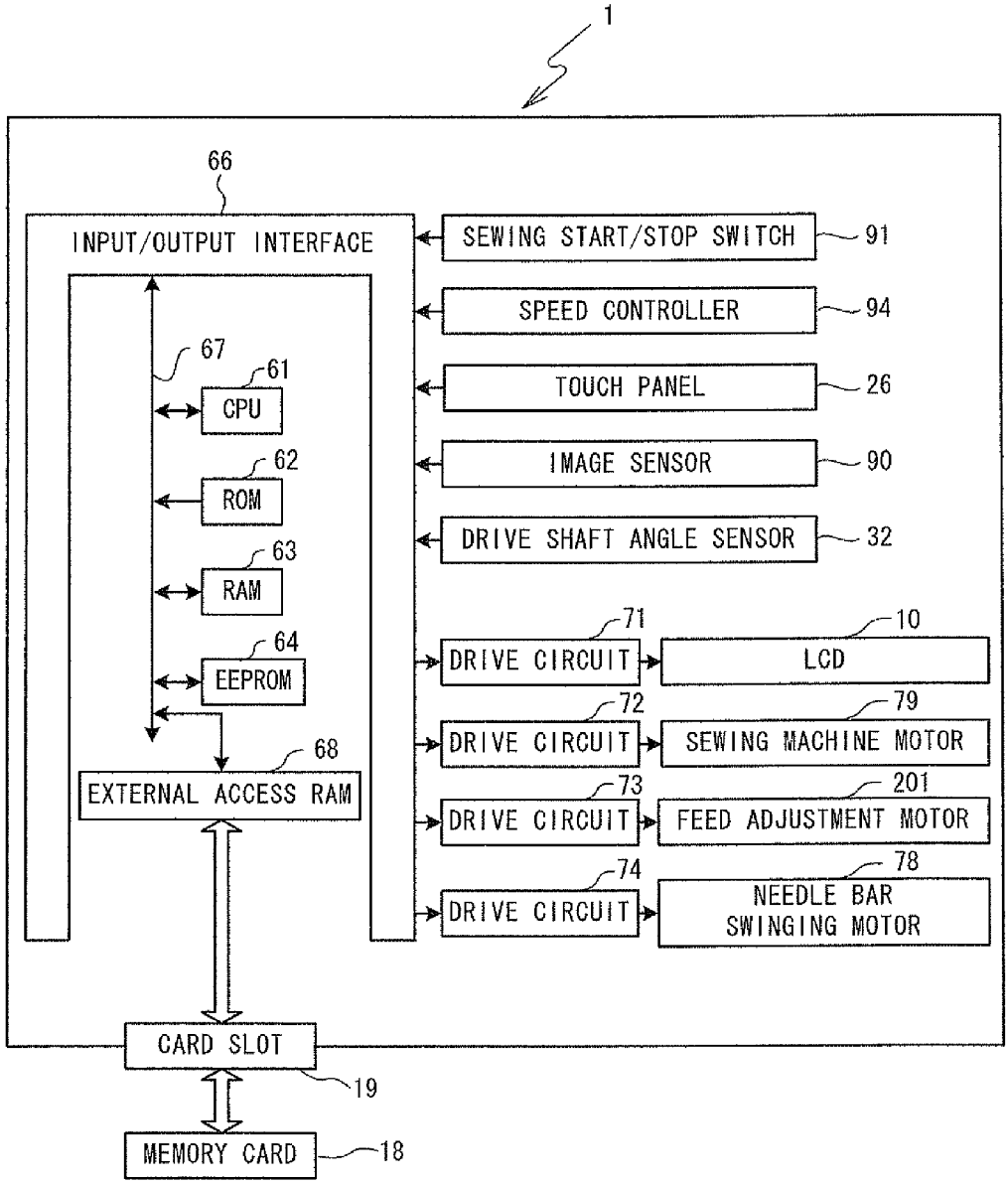
FIG. 5 is a block diagram that shows an electrical configuration of the sewing machine 1.

The electrical configuration of the sewing machine 1 will be explained with reference to FIG. 5. As shown in FIG. 5, the sewing machine 1 includes the CPU 61, a ROM 62, a RAM 63, an EEPROM 64, an external access RAM 68, and an input/output interface 66, which are connected to one another via a bus 67. The sewing start/stop switch 91, the speed controller 94, the touch panel 26, the image sensor 90, the drive shaft angle sensor 32, and drive circuits 71 to 74 are electrically connected to the input/output interface 66. The drive circuit 71 drives the LCD 10. The drive circuit 72 drives the sewing machine motor 79. The drive circuit 73 drives the feed adjustment motor 201. The drive circuit 74 drives the needle bar swinging motor 78.

The CPU 61 conducts main control over the sewing machine 1, and performs various types of computation and processing in accordance with a program stored in the ROM 62. The RAM 63 is a storage element that can be read from and written to as desired. The RAM 63 includes storage areas that store computation results and the like from computational processing by the CPU 61 as necessary. The EEPROM 64 stores various settings. A card slot 19 is connected to the external access RAM 68. The card slot 19 can be connected to a memory card 18. The sewing machine 1 can read and write information from and to the memory card 18 by connecting the card slot 19 and the memory card 18.

Figure 8:
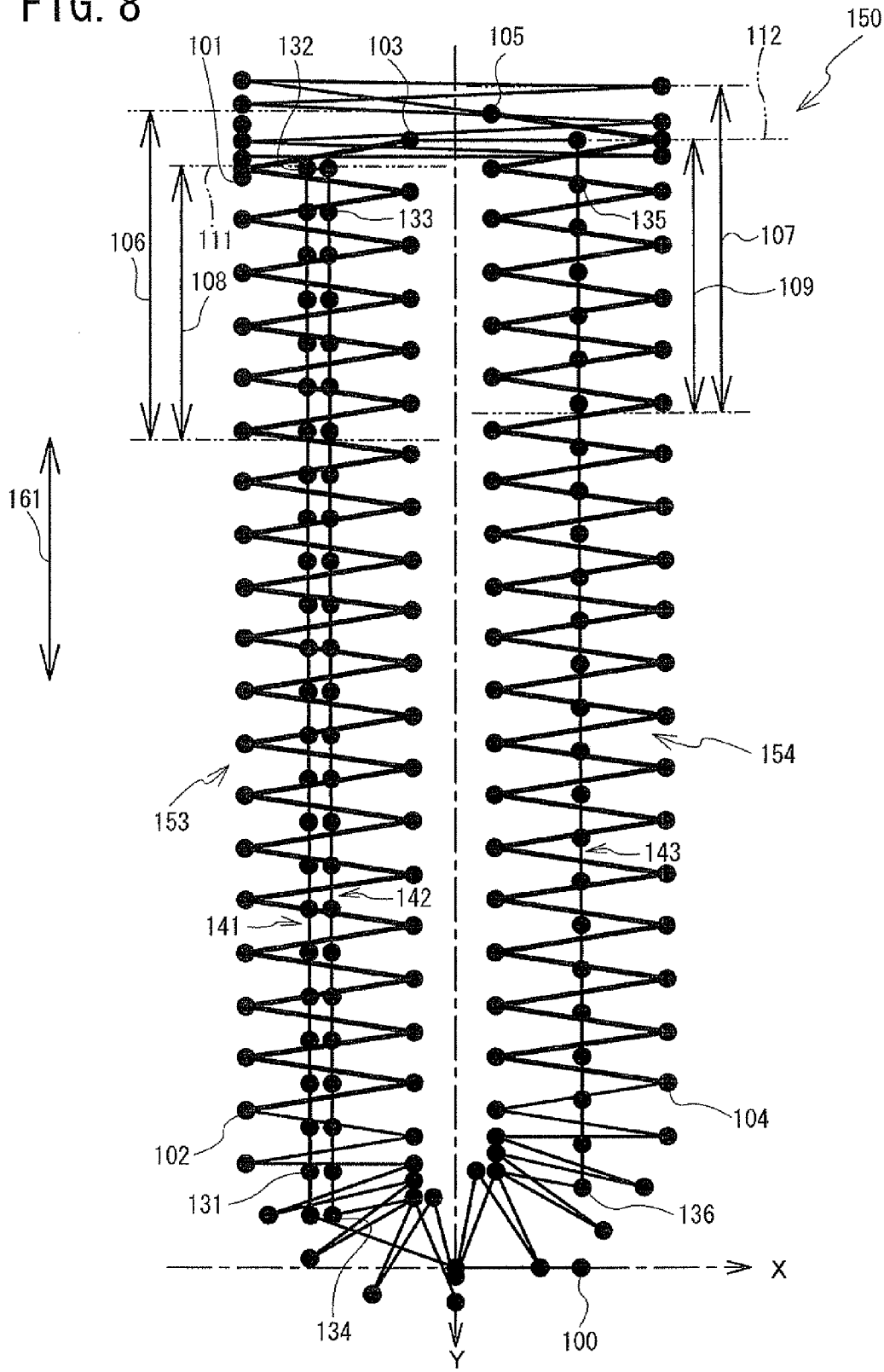
FIG. 8 is an explanatory figure of a buttonhole stitch set 150 that is formed in a case where sewing is performed based on the sewing data 600.

Sewing data 600 for forming a buttonhole stitch 150 will be explained with reference to FIGS. 6 to 8. The sewing data 600 that are shown in FIGS. 6 and 7 are data for forming the buttonhole stitch for a round ended buttonhole that is shown in FIG. 8. The sewing data 600 contain a plurality of data strings. Items (data items) that the data strings describe include feed amounts, swing amounts, and loop flags. The sewing data 600 are read and processed one line of data at a time. In the data tables that are shown in FIGS. 6 and 7, a data number is assigned to each of the data lines to facilitate the explanation. The feed amount that the sewing object is moved in the front-rear direction from a current position of the sewing object is stored in the data item "feed amount". The swing amount that the needle 16 is swung in the left-right direction is stored in the data item "swing amount". In the present embodiment, the feed amount and the swing amount are set to numerical values in units of 0.01 millimeters. A loop flag that indicates how the data will be processed is stored in the data item "loop flag". The loop flag is set to one of the values of zero, 1, and 2. The value of zero indicates that the data line will be used only once. The values of 1 and 2 are used in a case where the data line will be processed repeatedly. Hereinafter, the repeatedly performed processing of a data line is referred to as the repetition processing. The repetition processing is performed for all of the data lines from a data line in which the value of the loop flag is 1 to a data line in which the value of the loop flag is 2. In other words, during a period in which the repetition processing is being performed, once the data line with the loop flag of 2 is processed, the processing returns to the data line with the loop flag of 1.

The repetition processing is used for a first whipstitch portion 153 and a second whipstitch portion 154 that are shown in FIG. 8. The first whipstitch portion 153 and the second whipstitch portion 154 are formed in the long direction of the buttonhole stitch 150. The repetition processing is also used for underlying stitch portions 141 to 143. The data lines that correspond to the underlying stitch portions 141 to 143 are indicated by the data numbers 4 and 5, the data numbers 7 and 8, and the data numbers 23 and 24, respectively. The data lines that correspond to the first whipstitch portion 153 are indicated by the data numbers 20 and 21. The data lines that correspond to the second whipstitch portion 154 are indicated by the data numbers 36 and 37. The repetition processing is terminated when the length of the stitch portion that is being sewn in the long direction 161 of the buttonhole stitch 150 has become greater than the button size (the diameter of the button). The repetition processing makes it possible for the sewing machine 1 to sew buttonhole stitches of different sizes using a single set of the sewing data. The underlying stitch portions may not be sewn, depending on the type of the buttonhole stitch.

In a case where the stitches are formed by processing the sewing data 600 that are shown in FIGS. 6 and 7, the buttonhole stitch 150 that is shown in FIG. 8 may be formed, for example. The left side and the right side of the page of FIG. 8 respectively correspond to the left side and the right side of the buttonhole stitch 150. In FIG. 8, the black dots indicate the needle drop points, and the line segments that connect the needle drop points schematically indicate the stitches. A needle drop point 100 is the first needle drop point for the buttonhole stitch 150. A needle drop point 101 is the last needle drop point for the buttonhole stitch 150. As shown in FIG. 8, the stitches of the first whipstitch portion 153 are zigzag stitches that are formed on the left side of the buttonhole stitch 150. The starting point for the first whipstitch portion 153 is a needle drop point 102. The ending point for the first whipstitch portion 153 is a needle drop point 103. The needle drop point 103 is at the opposite end of the long direction 161 of the buttonhole stitch 150 from the needle drop point 102. The stitches of the second whipstitch portion 154 are zigzag stitches that are formed on the right side of the buttonhole stitch 150. The starting point for the second whipstitch portion 154 is a needle drop point 104. The ending point for the second whipstitch portion 154 is a needle drop point 105. The needle drop point 105 is at the opposite end of the long direction 161 of the buttonhole stitch 150 from the needle drop point 104. The first whipstitch portion 153 and the second whipstitch portion 154 extend in the long direction 161 of the buttonhole stitch 150.

The underlying stitch portions 141 and 142 are sewn as straight line stitches before the first whipstitch portion 153 is sewn. The starting point and the ending point of the underlying stitch portion 141 are a needle drop point 131 and a needle drop point 132, respectively. The starting point and the ending point of the underlying stitch portion 142 are a needle drop point 133 and a needle drop point 134. The underlying stitch portion 143 is sewn as straight line stitches before the second whipstitch portion 154 is sewn. The starting point and the ending point of the underlying stitch portion 143 are a needle drop point 135 and a needle drop point 136, respectively. The needle drop point 132, the needle drop point 134, and the needle drop point 136 are at the opposite end of the long direction 161 of the buttonhole stitch 150 from the needle drop point 131, the needle drop point 133, and the needle drop point 135, respectively. In FIG. 8, a straight line that is parallel to the long direction 161 of the buttonhole stitch 150 and that runs through the center of the width of the buttonhole stitch 150 is defined as the Y axis. The X axis is defined such that the Y coordinate of the needle drop point 100 is zero. The X axis and the Y axis define a coordinate system for the sewing object. In FIG. 8, the origin point corresponds to a reference position of the needle 16 when the sewing of the buttonhole stitch 150 starts. In FIG. 8, the scale of the Y axis and the scale of X axis are not the same. The line segments that indicate the stitches of the first whipstitch portion 153 and the second whipstitch portion 154 are thicker in order to be distinguished from the other stitches. The shape of the stitches is not different in the portions where the line segments that indicate the stitches are thicker.

Figure 9:
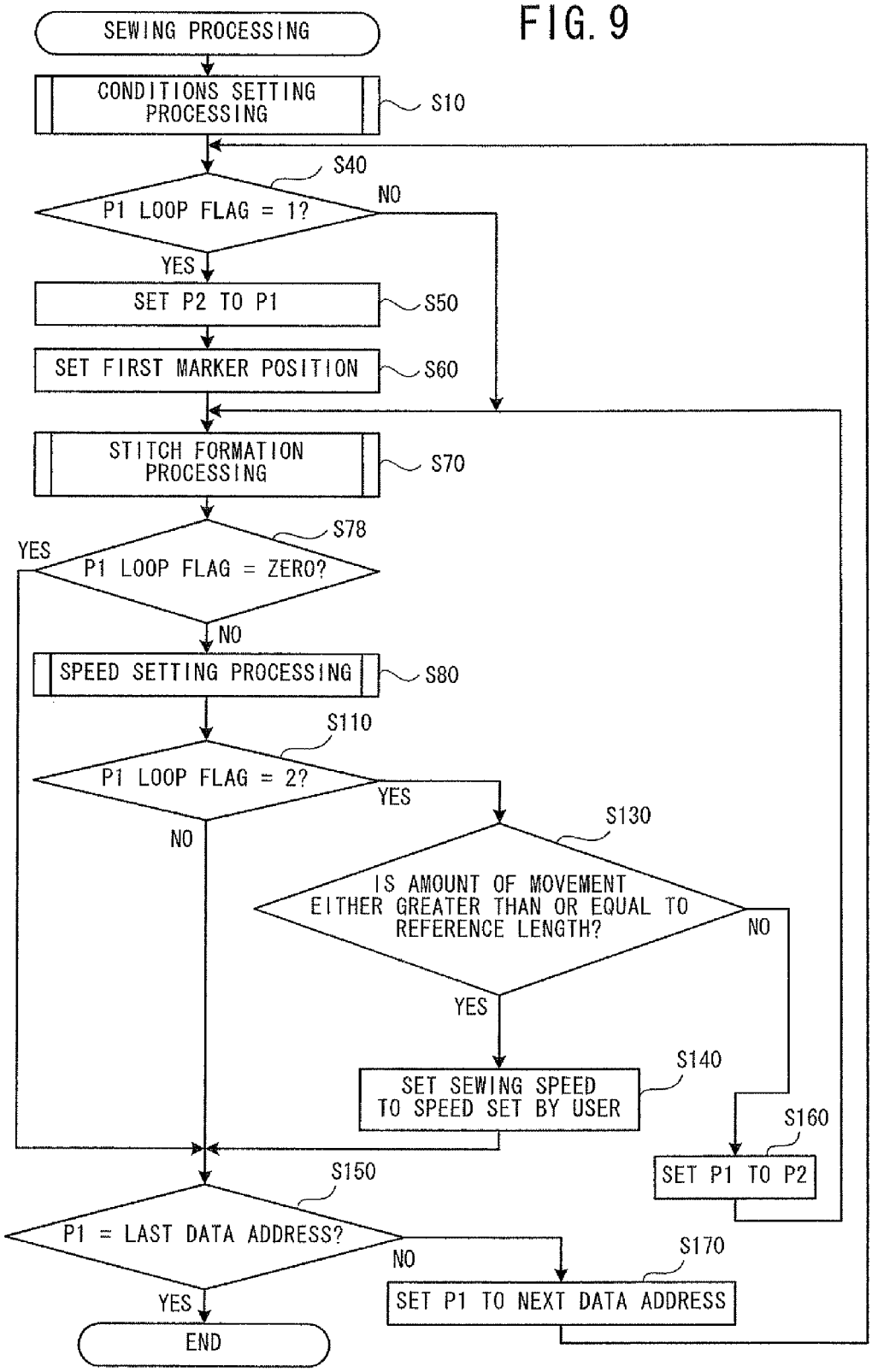
FIG. 9 is a flowchart of sewing processing.

Sewing processing will be explained with reference to FIGS. 9 to 15. The sewing processing according to the present embodiment may be performed when a stitch is formed using the presser 300 in FIG. 4. A program for performing the sewing processing is stored in the ROM 62 and is executed by the CPU 61. The sewing processing that is shown in FIG. 9 is started in a case where a command to start sewing is input after a type of stitch set and a length in a reference direction of a stitch portion that makes up at least a part of the stitch set been input by operating the touch panel 26. In the explanation that follows, the image that is described by the image data that are generated by the image sensor 90 is referred to as the captured image. The position of the marker 322 is described by three-dimensional coordinates for the center 342 of the marker 322 in a world coordinate system. The world coordinate system is a coordinate system that describes the whole of space. The world coordinate system is a coordinate system that is not affected by factors such as the center of gravity or the like of an object of which an image is captured. The origin point of the world coordinate system is defined by the coordinates of the needle drop point when the swing amount is zero. The three-dimensional coordinates are expressed as numerical values in units of 0.01 millimeters. The positions of the markers 323 and 324 are described by the three-dimensional coordinates for the center 342 in the world coordinate system, in the same manner as the position of the marker 322 is described.

Figure 10:
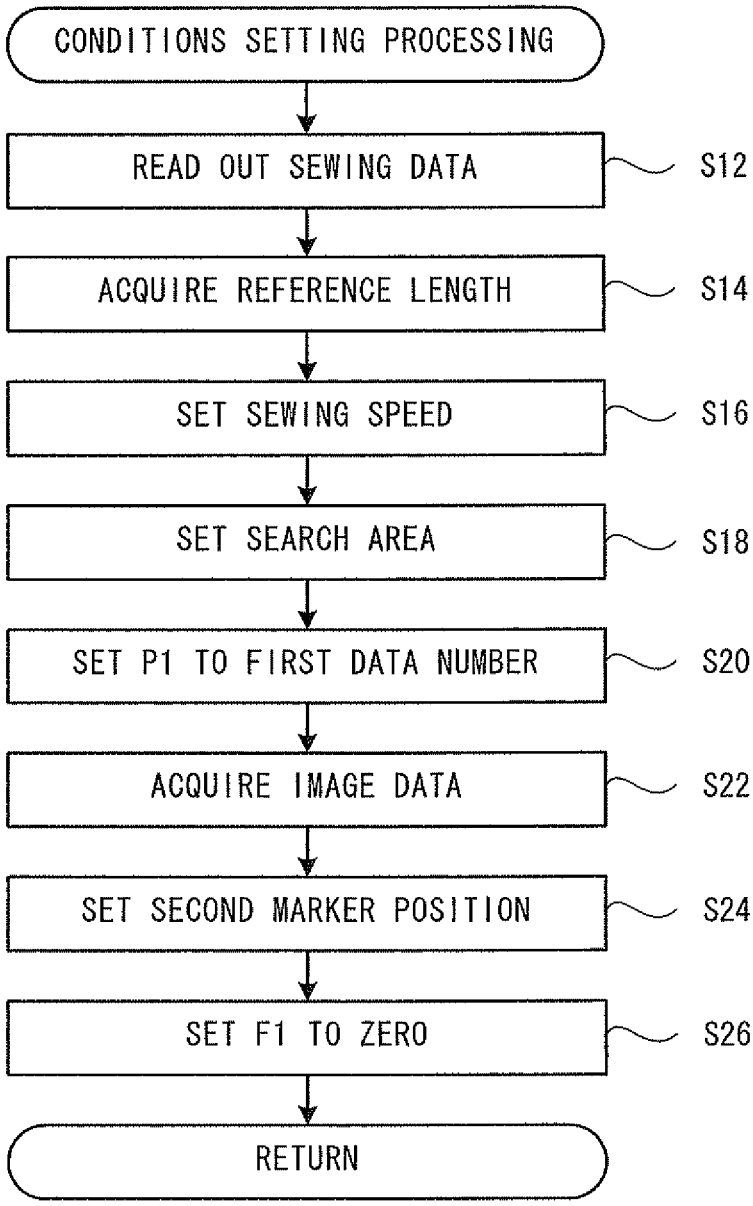
FIG. 10 is a flowchart of conditions setting processing that is performed in the sewing processing that is shown in FIG. 9.

As shown in FIG. 9, in the sewing processing, first, conditions setting processing is performed (Step S10). In the conditions setting processing, processing is performed that sets various types of conditions for performing the sewing processing. The conditions setting processing will be explained with reference to FIG. 10. As shown in FIG. 10, in the conditions setting processing, the sewing data that correspond to the type of stitch set that was selected before the sewing processing started are read out from the ROM 62, and the sewing data that have been read out are stored in the RAM 63 (Step S12). In the present embodiment, various types of buttonhole stitches, as well as a darning stitch and a bar tack stitch, may be selected as the stitch set that is to be sewn using the presser 300. Various types of shapes are available for the buttonhole stitch, not only the round ended buttonhole that is shown as an example in FIG. 8. The shape of the buttonhole stitch may be a round ended buttonhole, a double bar tack buttonhole, or an eyelet buttonhole, for example. The round ended buttonhole is a buttonhole stitch with at least one end that is rounded. The double bar tack buttonhole is a buttonhole stitch with straight line stitching at both ends. The eyelet buttonhole is a buttonhole stitch in which the rounded end is slightly enlarged. With the darning stitch, a straight stitch portion that extends in the front-rear direction of the presser 300 is sewn in a plurality of rows in the left-right direction of the presser 300. For example, Japanese Laid-Open Patent Publication No. S60-111685 discloses the darning stitch, the relevant portions of which are incorporated by reference. The bar tack stitch is a type of reinforcement stitch. The bar tack stitch is used when reinforcing an area where force will come to bear, such as the opening of a pocket, the end of a slit, and the like. A specific example is assumed in which the sewing data that are acquired according to the selected type of stitch set in the processing at Step S12 are the sewing data that correspond to the round ended buttonhole that is shown as an example in FIG. 8.

Next, the length in the reference direction of the stitch portion that makes up at least a part of the selected type of stitch set is acquired, and the acquired length in the reference direction is stored in the RAM 63 (Step S14). Hereinafter, the length of the stitch portion in the reference direction is referred to as the reference length. In the processing at Step S14, a value is acquired that was input before the sewing processing started. In the present embodiment, the stitch portion and the reference direction are set in advance according to the type of the stitch set. In a case where the type of the stitch set is a buttonhole stitch, the stitch portion includes a whipstitch portion and a underlying stitch portion that are formed in the long direction of the buttonhole stitch. The reference direction is the long direction of the buttonhole stitch. In the present embodiment, the button size is acquired as the length of the whipstitch portion and the underlying stitch portion in the long direction of the buttonhole stitch. In the processing at Step S14, an image of the button may be captured by the image sensor 90, the button size may be computed based on the captured image, and the computed value may be acquired. In a case where the type of the stitch set is a darning stitch, the stitch portion is a straight stitch portion that extends in the reference direction, and the reference direction is the feed direction (the front-rear direction of the presser 300). In a case where the type of the stitch set is a bar tack stitch, the stitch portion is the entire bar tack stitch, and the reference direction is the feed direction (the front-rear direction of the presser 300). As described above, the reference direction according to the present embodiment is the feed direction (the front-rear direction of the presser 300), regardless of the type of the stitch set. In the specific example, a value of 2.0 centimeters, for example, may be acquired as the button size in the processing at Step S14.

Next, a speed that has been designated by using the speed controller 94 is set as the sewing speed, and the sewing speed that has been set is stored in the RAM 63 (Step S16). For example, 1000 rpm may be set as the sewing speed. Next, a setting for an area for searching for a marker within the captured image is read out from the EEPROM 64 as a setting for a search area, and the setting that has been read out is stored in the RAM 63 (Step S18). In the present embodiment, a part of the captured image in which it is assumed that at least one of the markers 322 to 324 is located is set as the search area. Specifically, the search area is a square area measuring 10 millimeters on a side that includes a position where it is assumed that a marker is located.

Next, a first pointer P1 is set to the data number for the first data line in the sewing data, and the first pointer P1 that has been set is stored in the RAM 63 (Step S20). The first pointer P1 is a variable that is used in processing that specifies the data line that will be processed. Next, the image data that have been generated by the image sensor 90 are acquired, and the acquired image data are stored in the RAM 63 (Step S22). When the sewing processing starts, the marker 322 is positioned within the image capture area 380 of the image sensor 90, as shown in FIG. 4. Next, the position of the marker 322 is computed based on the image data that were acquired in the processing at Step S22. The computed position of the marker 322 is stored in the RAM 63 as a second marker position (Step S24). The second marker position describes the current position of the marker 322. The second marker position is set based on the position of the marker 322 that was computed based on the captured image and based on the feed amount that is described by the sewing data. After the image capture by the image sensor 90 (Step S22), the sewing object is not moved. Therefore, in the processing at Step S24, the second marker position is set to the position of the marker 322 that was computed based on the captured image. Next, F1 is set to zero, F1 that has been set is stored in the RAM 63 (Step S26). F1 is a variable that is used in processing that calculates the amount of movement of the marker 322 (the sewing object). The conditions setting processing is then terminated, and the processing returns to the sewing processing that is shown in FIG. 9.

After the conditions setting processing has been performed (Step S10), a determination is made as to whether the value of the loop flag in the data line that is indicated by the first pointer P1 is 1 (Step S40). If the value of the loop flag is 1 (YES at Step S40), a second pointer P2 is set to the value of the first pointer P1, and the second pointer P2 that has been set is stored in the RAM 63 (Step S50). The second pointer P2 is a variable for storing the data number for the most recent data line in which the value of the loop flag is 1. Next, the first marker position is set to the sum of the second marker position and F1, and the first marker position that has been set is stored in the RAM 63 (Step S60). The first marker position describes the position of the marker 322 when the repetition processing is started. If the value of the loop flag is not 1 (NO at Step S40), as well as after the first marker position has been set (Step S60), stitch formation processing is performed based on the sewing data in the data line that is indicated by the first pointer P1 (Step S70).

Figure 11:
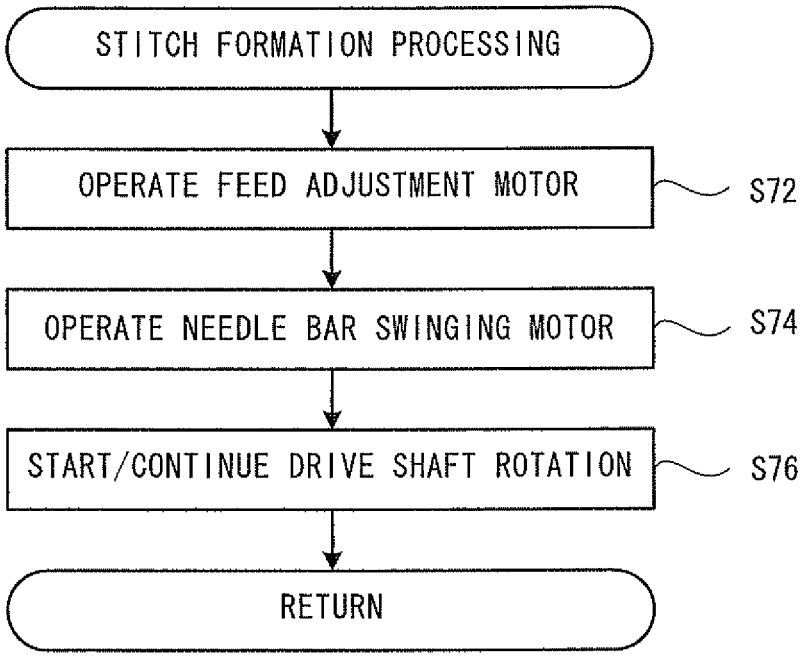
FIG. 11 is a flowchart of stitch formation processing that is performed in the sewing processing that is shown in FIG. 9.

The stitch formation processing will be explained in detail with reference to FIG. 11. As shown in FIG. 11, in the stitch formation processing, operation of a feed adjustment motor 201 is started when a control signal is output to the drive circuit 73 based on the feed amount in the data line that is indicated by the first pointer P1 (Step S72). Next, operation of a needle bar swinging motor 78 is started when a control signal is output to the drive circuit 74 based on the swing amount in the data line that is indicated by the first pointer P1 (Step S74). The processing at Steps S72 and S74 is performed in a state in which the needle 16 is higher than the sewing object. The processing at Steps S72 and S74 causes the sewing object to be moved to the position that is designated by the sewing data. For example, in a case where the data line that is indicated by the first pointer P1 is 1, as shown in FIG. 12, the position on the sewing object that is indicated by the coordinates (X, Y)=(150, 0) in the coordinate system that is shown in FIG. 8 is positioned directly below the needle 16. Next, a control signal is output to the drive circuit 72. In a case where the drive shaft 51 is not rotating, the drive circuit 72 causes the drive shaft 51 to start rotating. In a case where the drive shaft 51 is already rotating, the drive circuit 72 causes the drive shaft 51 to continue rotating (Step S76). The revolution speed of the drive shaft 51 is adjusted to the sewing speed that is stored in the RAM 63. The stitch formation processing is terminated, and the processing then returns to the sewing processing that is shown in FIG. 9.

After the stitch formation processing has been performed (Step S70), a determination is made as to whether the value of the loop flag in the data line that is indicated by the first pointer P1 is zero (Step S78). If the value of the loop flag is zero (YES at Step S78), the processing at Step S150, which will be described below, is performed. If the value of the loop flag is not zero (NO at Step S78), speed setting processing is performed (Step S80). In the specific example, in the speed setting processing, the revolution speed of the sewing machine motor 79 is set to a specified value in a case where the sewing is performed in each of specified ranges that are set for the stitch portions that are sewn by the repetition processing. As explained above, in the specific example, the stitch portions that are sewn by the repetition processing are the first whipstitch portion 153, the second whipstitch portion 154, and the underlying stitch portions 141 to 143. The speed setting processing will be explained in detail with reference to FIG. 13. As an example, a case will be explained in which the speed setting processing is performed when one of the first whipstitch portion 153 and the second whipstitch portion 154 is being sewn.

Figure 13:
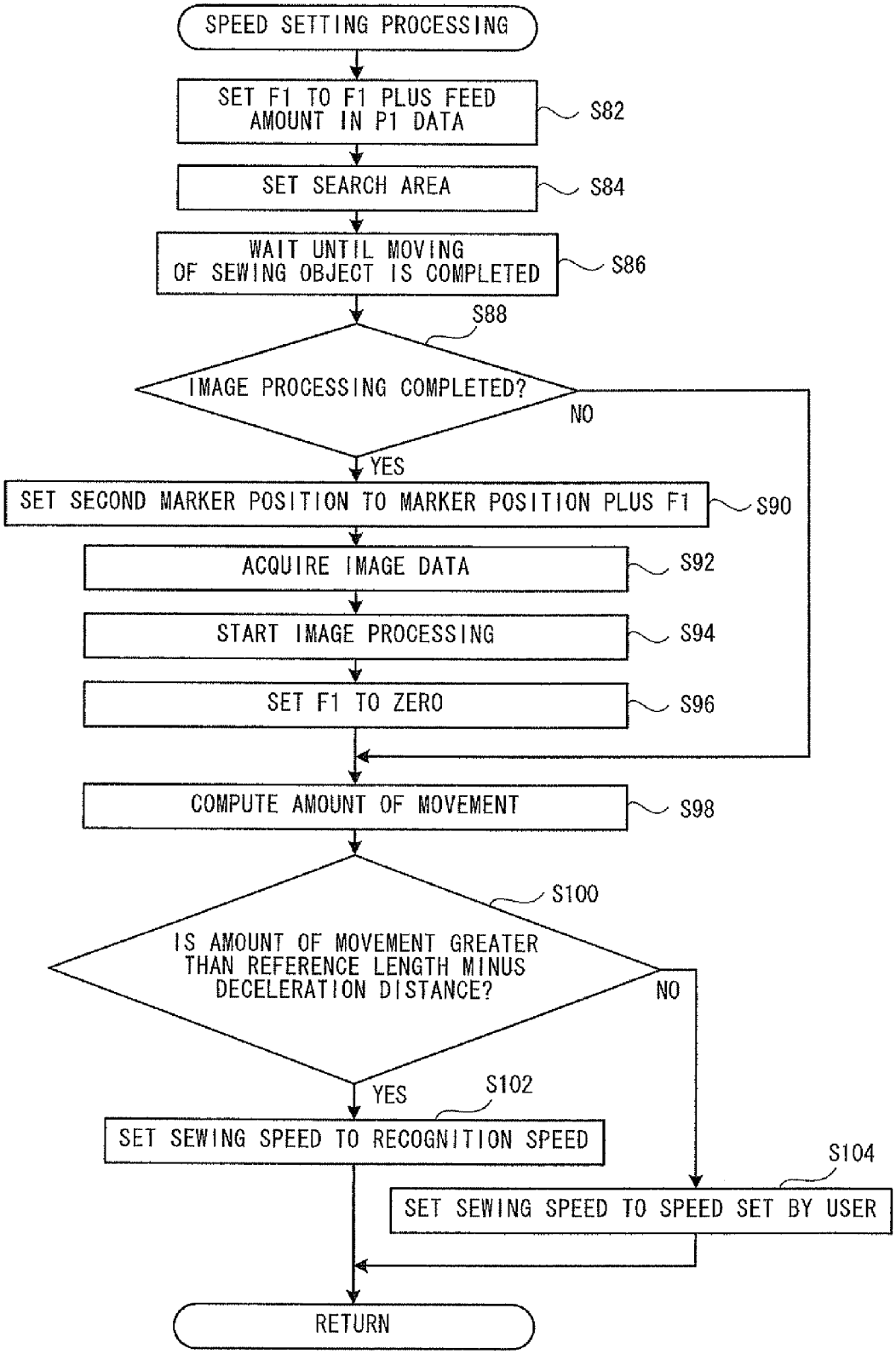
FIG. 13 is a flowchart of speed setting processing that is performed in the sewing processing that is shown in FIG. 9.

As shown in FIG. 13, in the speed setting processing, first, F1 is set to the sum of F1 and the feed amount in the data line that is indicated by the first pointer P1 F1 that has been set is stored in the RAM 63 (Step S82). Next, the search area for the marker in the captured image is set based on F1, the second marker position, and the current search area setting (Step S84). The search area may be set for the next procedure, for example. First, the predicted positions of the markers 322 to 324 are computed. The predicted position of the marker 322 is expressed as the sum of F1 and the second marker position. The predicted position of the marker 323 is expressed as the value that is calculated by subtracting the interval 332 from the position of the marker 322. The predicted position of the marker 324 is expressed as the value that is calculated by subtracting twice the interval 332 from the position of the marker 322.

Figure 4:
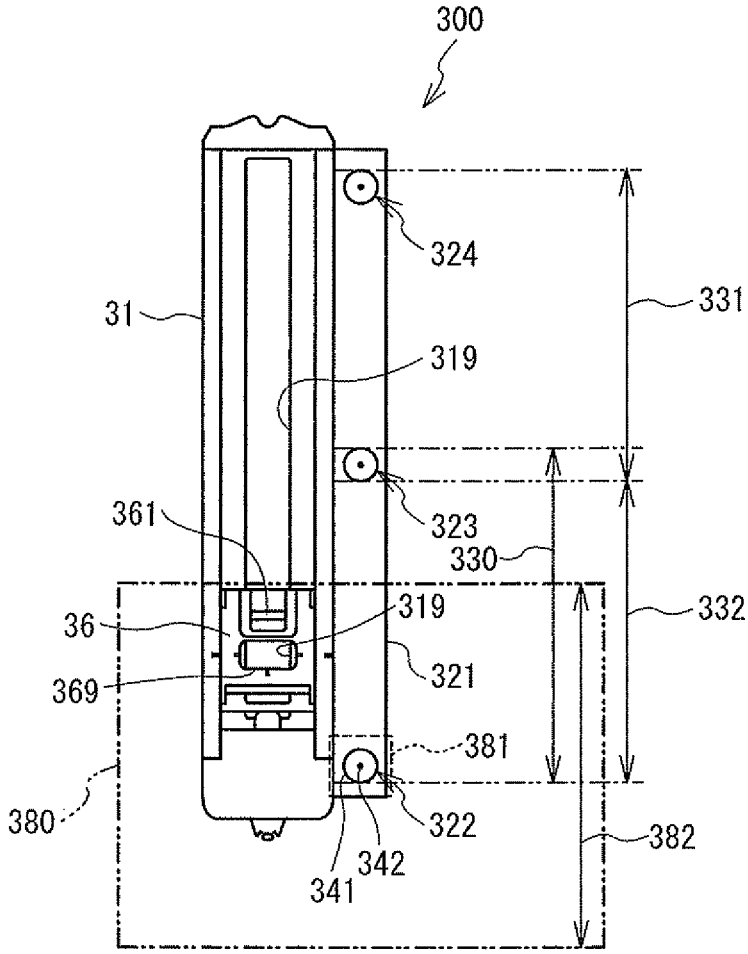
FIG. 4 is a plan view of a presser 300 for buttonhole stitching.
Figure 14:
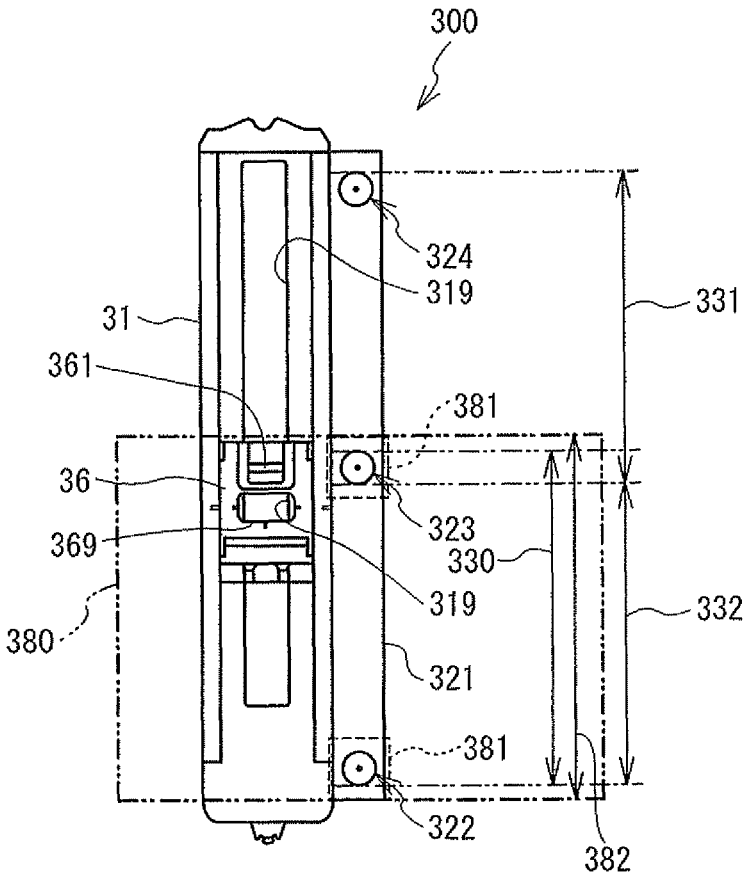
FIG. 14 is a plan view of the presser 300 for buttonhole stitching in a case where a presser portion 31 has been moved 25 millimeters forward from an initial position.
Figure 15:
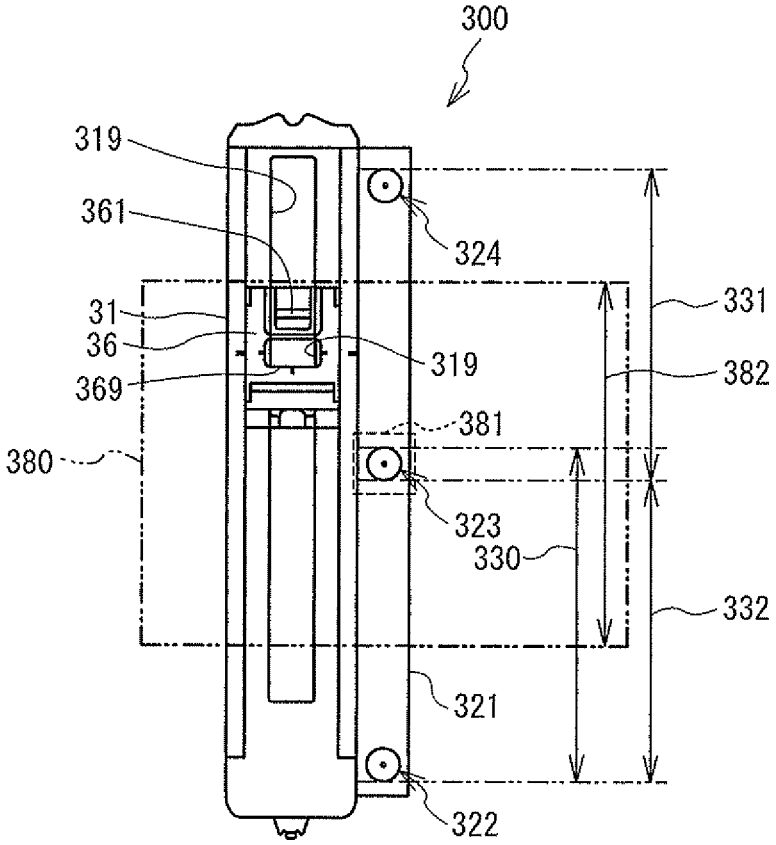
FIG. 15 is a plan view of the presser 300 for buttonhole stitching in a case where the presser portion 31 has been moved 50 millimeters forward from the initial position.

In a case where the predicted position of the marker 322 is within the image capture area 380 as shown in FIG. 4, a 10 millimeter square that includes the predicted position of the marker 322 is set as a search area 381. In a case where the presser portion 31 has been moved 25 millimeters toward the front from the initial position that is shown in FIG. 4, both the marker 322 and the marker 323 are positioned within the image capture area 380, as shown in FIG. 14. In this case, a 10 millimeter square that includes the predicted position of the marker 322 and a 10 millimeter square that includes the predicted position of the marker 323 are both set as the search areas 381. In a case where the predicted position of the marker 323 is within the image capture area 380 as shown in FIG. 15, then a 10 millimeter square that includes the predicted position of the marker 323 is set as the search area 381. In a case where the predicted position of the marker 324 is within the image capture area 380, then a 10 millimeter square that includes the predicted position of the marker 324 is set as the search area 381. A slight error for each individual product, due to manufacturing errors, may be incorporated into the interval 332. Therefore, in the present embodiment, the interval that is actually measured based on the image data is used for calculations. For example, the interval between the marker 322 and the marker 323 is computed based on the image data that describe the image capture area 380 that is shown in FIG. 14. The interval between adjacent markers may be computed based on the image data every time the sewing processing is performed. The computed value for the interval between adjacent markers may be stored in the EEPROM 64 or the like, and the stored interval value may be read out from the EEPROM 64 when the sewing processing is performed.

Next, the processing waits until the moving of the sewing object that was started in the processing at Steps S72 and S74 in FIG. 11 is completed (Step S86). Next, a determination is made as to whether image processing has been completed (Step S88). The image processing is started by the processing at Step S94, which will be described below. In the case of the first iteration of the processing at Step S88 (YES at Step S88), as well as in a case where the image processing has been completed in a second or subsequent iteration of the processing at Step S88 (YES at Step S88), processing is performed that computes the amount of movement of the marker 322 (the sewing object) based on the captured image. Specifically, first the second marker position is set to the sum of F1 and the marker position that is computed by the image processing, and the second marker position that has been set is stored in the RAM 63 (Step S90). The marker 322 is moved by the distance F1 from the position of the marker at the time of the previous image capture. Therefore, the second marker position is set to the value that is the sum of F1 and the previous marker position.

Next, the image data that have been generated by the image sensor 90 are acquired, and the acquired image data are stored in the RAM 63 (Step S92). Specifically, the image data are acquired that describe an image of the sewing object that has been captured while the movement of the sewing object is stopped. Next, the image processing is started (Step S94). In the image processing, of the captured image that is described by the image data that were acquired in the processing at Step S92, an image in the search area 381 that was set in the processing at Step S84 is used, a search is performed for at least one of the markers 322 to 324, and the three-dimensional coordinates for the marker 322 are computed. For example, Japanese Laid-Open Patent Publication No. 2009-172123 discloses the processing that searches for a marker based on image data, the relevant portions of which are incorporated by reference. In a case where the marker 322 is positioned within the image capture area 380, as shown in FIGS. 4 and 14, the three-dimensional coordinates for the position of the marker 322 may be computed based on the image data. In a case where the marker 322 is not positioned within the image capture area 380, the three-dimensional coordinates for the position of the marker 322 may be computed based on the position of another marker, which is computed based on the image data, and on the interval between the other marker and the marker 322.

Examples of the computation of the position of the marker 322 that is described by the three-dimensional coordinates of the world coordinate system in the examples in FIGS. 4, 14, and 15 will be explained. The position of the marker 322 that is shown in FIG. 4 may be computed based on the image data to be (X, Y, Z)=(100, 210, 110), for example. The position of the marker 322 that is shown in FIG. 14 may be computed based on the image data to be (X, Y, Z)=(100, 2710, 110), for example. The position of the marker 323 that is shown in FIG. 14 may be computed based on the image data to be (X, Y, Z) (90, −2270, 110), for example. The interval between the marker 322 and the marker 323 that is shown in FIG. 14 may be computed based on the position of the marker 322 and the position of the marker 323 to be (X, Y, Z)=(10, 4980, 0), for example. The position of the marker 323 that is shown in FIG. 15 may be computed based on the image data to be (X, Y, Z)=(90, 230, 110), for example. In this case, the position of the marker 322 that is shown in FIG. 15 is computed to be (X, Y, Z)=(100, 5210, 110). Next, F1 is set to zero, and F1 that has been set is stored in the RAM 63 (Step S96).

If the image processing has not been completed (NO at Step S88) in the second and subsequent iterations of the processing at Step S88, as well as after F1 has been set to zero (Step S96), the amount of movement of the marker 322 (the sewing object) is computed, and the computed amount of movement is stored in the RAM 63 (Step S98). The amount of movement is the amount of movement of the marker 322 (the sewing object) in the feed direction (the front-rear direction of the sewing machine 1) after the repetition processing is started. The amount of movement is obtained as (amount of movement)=|(second marker position)+(F1)−(first marker position)|. The expression (second marker position)+(F1) describes the current position of the marker 322.

Next, a determination is made as to whether the amount of movement of the marker 322 (the sewing object) is greater than the reference length minus a deceleration distance (Step S100). The processing at Step S100 is performed in order to determine, based on the amount of movement of the marker 322, whether the sewing has been performed for the specified range that has been set at the ending point side of one of the first whipstitch portion 153 and the second whipstitch portion 154. The reference length in the specific example is the button size. The deceleration distance in the specific example is set to a distance P from each of planned ending lines 111 and 112 in the feed direction of the first whipstitch portion 153 and the second whipstitch portion 154. The planned ending line 111 is set at a position that is separated from the needle drop point 102 (the starting point) of the first whipstitch portion 153 by a distance in the negative Y axis direction (the long direction 161) that is equal to the button size. The planned ending line 112 is set at a position that is separated from the needle drop point 104 (the starting point) of the second whipstitch portion 154 by a distance in the negative Y axis direction (the long direction 161) that is equal to the button size. The distance P may be set by taking into consideration conditions that include the speed of the image processing and the feed amount per stitch. In FIG. 8, the distance P is indicated by an arrow 108 and an arrow 109. In the specific example, as shown in FIG. 8, the specified ranges that are set at the ending point sides of the first whipstitch portion 153 and the second whipstitch portion 154 include a first range that is indicated by an arrow 106 and a second range that is indicated by an arrow 107, respectively.

The first range is a range that extends in the positive Y axis direction (the long direction 161) from the planned ending line 111 by a length that is indicated by the arrow 108 and that extends in the negative Y axis direction (the long direction 161) from the planned ending line 111 by a length that is equal to the feed amount for two stitches of the first whipstitch portion 153. The second range is a range that extends in the positive Y axis direction (the long direction 161) from the planned ending line 112 by a length that is indicated by the arrow 109 and that extends in the negative Y axis direction (the long direction 161) from the planned ending line 112 by a length that is equal to the feed amount for two stitches of the second whipstitch portion 154. In the present embodiment, the lengths of the first and second whipstitch portions 153, 154 are adjusted in units of two stitches. Therefore, the first range and the second range extend in the negative Y axis direction (the long direction 161) from the planned ending line 111 and the planned ending line 112, respectively, by lengths that are equal to the feed amount for two stitches of the first and second whipstitch portions 153, 154, respectively. The positions of the specified ranges may differ from the positions that are shown in FIG. 8, depending on the type of the buttonhole stitch, that is, on the sewing data for the buttonhole stitch. If the amount of movement of the marker 322 is greater than the reference length minus the deceleration distance (YES at Step S100), the sewing speed is set to a recognition speed, and the sewing speed that has been set is stored in the RAM 63 (Step S102). The recognition speed is stored in the EEPROM 64 in advance and is set such that the time that is required in order to perform the image processing for one captured image is shorter than the time that is required in order to sew one stitch according to the sewing data. For example, the recognition speed may be 400 rpm. If the amount of movement of the marker 322 is not greater than the reference length minus the deceleration distance (NO at Step S100), the speed that has been designated by using the speed controller 94 is set as the sewing speed, in the same manner as in the processing at Step S16 in FIG. 10, and the sewing speed that has been set is stored in the RAM 63 (Step S104). After the sewing speed has been set (one of Steps S102 and S104), the processing returns to the sewing processing that is shown in FIG. 9.

After the speed setting processing has been performed (Step S80), a determination is made as to whether the loop flag is 2 in the data line that is indicated by the first pointer P1 (Step S110). If the loop flag is 2 (YES at Step S110), a determination is made as to whether the amount of movement that was computed in the processing at Step S98 in FIG. 13 is not less than the reference length that was acquired in the processing at Step S14 in FIG. 10 (Step S130). If the amount of movement is less than the reference length (NO at Step S130), the first pointer P1 is set to the value of the second pointer P2, and the first pointer P1 that has been set is stored in the RAM 63 (Step S160). Next, the processing returns to Step S70, and the repetition processing is continued. In the specific example, the repetition processing is performed nineteen times each for the data lines that are indicated by the data numbers 20 and 21 that are shown in FIG. 6 for sewing the first whipstitch portion 153 and for the data lines that are indicated by the data numbers 36 and 37 that are shown in FIG. 7 for sewing the second whipstitch portion 154. The same sort of repetition processing is also performed when the underlying stitch portions 141 to 143 are sewn. For example, data lines that are indicated by the data numbers 4 and 5 for sewing the underlying stitch portion 141 are shown in a portion of FIG. 12, and the repetition processing is performed twelve times. If the amount of movement is not less than the reference length (YES at Step S130), the speed that has been designated by using the speed controller 94 is set as the sewing speed, in the same manner as in the processing at Step S16 in FIG. 10, and the sewing speed that has been set is stored in the RAM 63 (Step S140).

If the loop flag in the data line that is indicated by the first pointer P1 is not 2 (NO at Step S110), as well as after the sewing speed has been set (Step S140), a determination is made as to whether the data in the data line that is indicated by the first pointer P1 are the last data (Step S150). If the data in the data line that is indicated by the first pointer P1 are not the last data (NO at Step S150), the first pointer P1 is set to the next data address (the next data number), and the first pointer P1 that has been set is stored in the RAM 63 (Step S170). Next, the processing returns to Step S40. In a case where the data in the data line that is indicated by the first pointer P1 are the last data (YES at Step S150), the sewing processing is terminated. The repetition processing, that is, the sewing of the one of the whipstitch portions, is terminated by the processing at one of Steps S150 and S170 that are performed after it is determined, in the processing at Step S130, that the amount of movement is not less than the reference length (YES at Step S130).

According to the sewing machine 1 described above, the revolution speed of the sewing machine motor 79 (the sewing speed) is set to the recognition speed in cases where the sewing will be performed in the specified ranges that are indicated by the arrow 106 and the arrow 107 in FIG. 8 for the first whipstitch portion 153 and the second whipstitch portion 154. The revolution speed of the sewing machine motor 79 (the sewing speed) is set to the recognition speed in those cases where the sewing will be performed in the specified ranges that are set at the ending point sides of the underlying stitch portions 141 to 143, although the specified ranges are not shown in FIG. 8. The recognition speed is set by taking into consideration the speed of the image processing. It is therefore possible to avoid a situation in which the length of the stitch portion deviates from the designated length due to the inertial force of the feed mechanism or to thread tension. It is also possible to reliably avoid a situation in which the length of the stitch portion cannot be appropriately computed because the processing for computing the amount of movement of the marker 322 based on the image data cannot follow the revolution speed of the sewing machine motor 79. It is therefore possible for the sewing machine 1 to form a stitch portion of a designated size more accurately. It is also possible for the sewing machine 1 to set the type of the stitch set to various types of buttonhole stitches. Thus, the first whipstitch portion 153 and the second whipstitch portion 154 of the designated lengths may be sewn accurately based on the image data that have been generated by the image sensor 90.

The markers 322 to 324 are disposed on the marker positioning portion 321 of the presser 300. It is therefore possible to eliminate the user's time and effort of positioning the markers 322 to 324 on one of the sewing object and the presser for buttonhole stitching every time the sewing is performed. In the sewing machine 1, the presser portion 31 may press down on the sewing object around the portion where the stitch will be formed. It is therefore possible to form a stitch with less contraction of the sewing object than in a case where a stitch portion is formed using an ordinary presser foot. In a case where a stitch is formed using the presser 300, at least one of the markers 322 to 324 is located within the image capture area 380 of the image sensor 90. It is therefore possible to accurately recognize the position where the stitch portion will be switched (where the sewing one of the stitch portions ends), even in a case where a stitch portion is formed that has a long length in the reference direction. The sewing machine 1 computes the intervals between adjacent markers based on the image data. This makes it possible for the sewing machine 1 to accurately compute the position of the marker 322, even in a case where the intervals between the markers vary due to manufacturing errors or the like. The sewing machine 1 sets the search area 381 in a part of the image that is described by the image data that have been generated by the image sensor 90. It is therefore possible for the sewing machine 1 to make the processing for computing the amount of movement of one of the markers simpler than in a case where the image processing is performed using the entire image.

The sewing machine according to the present disclosure is not limited to the embodiment that is described above, and various types of modifications may be made within the scope of the present disclosure. For example, the modifications (A) to (C) below may be made as desired.

(A) The configuration of the sewing machine may be modified as desired. For example, the sewing machine according to the present disclosure may be used in a multi-needle sewing machine and in an industrial sewing machine. The type and the positioning of the image sensor 90 may be modified as desired. For example, the image sensor 90 may be an image capture element other than a CMOS image sensor, such as a CCD camera or the like.

(B) The configuration of the markers 322 to 324 may be modified as desired. The configuration of the markers may include, for example, a pattern, a color, a shape, a material, a number, and a positioning. The markers may be positioned within an image capture area on the surface of the sewing object. In a case where there is a graphic pattern on the surface of the sewing object, a specific portion of the pattern may be used instead of the markers. In a case where a plurality of the markers are used, the markers may have the same pattern, or the markers may have a different pattern. In a case where a plurality of the markers are used, the intervals between the adjacent markers may be modified as desired. The intervals between the adjacent markers may be set without taking the image capture area of the image sensor 90 into consideration. It is permissible to dispose only one marker on the presser portion 31 of the presser 300. In the present embodiment, the position of the center 342 of the marker 322 is defined as the position of the marker 322. However, the position of the marker 322 may be defined as a position other than the position of the center 342 of the marker 322. The point whose coordinates are used to define the position of the marker may be modified as desired according to the configuration of the marker.

(C) The sewing processing may be modified as necessary. The example modifications (C-1) to (C-5) described below may be made.

(C-1) The types of the stitch sets that can be set in the processing at Step S12 in FIG. 10 may be modified as desired. For example, the types may be modified such that only buttonhole stitches can be selected. In the embodiment that is described above, in a case where the type of the stitch set is the buttonhole stitch 150, the lengths of the first whipstitch portion 153 and the second whipstitch portion 154 are defined as the button diameter (the button size) in the processing at Step S14. However, the lengths of the first whipstitch portion 153 and the second whipstitch portion 154 may be defined as other than the button size. For example, the lengths of the first whipstitch portion 153 and the second whipstitch portion 154 may be defined as the sum of the button diameter and the button thickness. The stitch portions that are included in the stitch sets, as well as the reference directions of the stitch portions, may be modified as desired according to the type of the stitch set, or may be designated by the user.

(C-2) In the embodiment that is described above, the processing at Step S130 is performed only in a case where the loop flag is 2 in the data line that is indicated by the first pointer P1 (YES at Step S110). That is, the length of the stitch portion that is formed by the repetition processing is adjusted in units of two stitches. However, even when the loop flag is 1 in the data line that is indicated by the first pointer P1, the processing at Step S130 may be performed in the same manner, and the length of the stitch portion may be adjusted in units of one stitch.

(C-3) The sewing machine 1 sets the sewing speed to the recognition speed in a case where, in the processing at Step S100 in FIG. 13, the amount of movement of the marker 322 is greater than the reference length minus the deceleration distance (YES at Step S100) (Step S102). However, the sewing speed that is set in the processing at Step S102 may be set such that the sewing speed is not greater than a specified value that is set by taking into consideration the speed of the image processing. For example, in a case where the sewing speed that is set by the user is slower than the recognition speed, in the processing at Step S102, the sewing speed may be set to the speed that is set by the user. In a case where a plurality of stitch portions are sewn by the repetition processing, the specified range may be set, and the processing that adjusts the sewing speed may be performed, only for at least one of the stitch portions. For example, in the specific example, the specified ranges are set, and the processing that adjusts the sewing speed is performed, only for the first whipstitch portion 153 and the second whipstitch portion 154.

(C-4) In the image processing, the entire captured image may be set as the search area. In that case, the processing at Step S18 in FIG. 10 may be omitted.

(C-5) The sewing speed that is set in the processing at Step S140 in FIG. 9, in the processing at Step S16 in FIG. 10, and in the processing at Step S104 in FIG. 13 is not limited to the speed that is set by the user. The sewing speed may be set separately for each type of stitch set, for example. The deceleration distance that is used in the processing at Step S100 may be modified as desired according to the type of the stitch set.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine, comprising:

a needle bar;

a sewing machine motor configured to drive the needle bar up and down;

an acquisition portion configured to acquire a reference length that is a length of a stitch portion in a reference direction, the stitch portion being at least one part of a stitch set that is to be sewn on a sewing object;

an image capture portion configured to generate image data by image capture of one of the sewing object and at least one marker that is moved together with the sewing object;

a computation portion configured to compute an amount of movement of one of the sewing object and the at least one marker, based on at least the image data that have been generated by the image capture portion;

a speed control portion configured to set a revolution speed of the sewing machine motor to not greater than a specified value in a case where it is determined, based on the amount of movement that has been computed by the computation portion, that sewing is being performed in a specified range that has been set at an opposite side of the stitch portion from a starting point of the stitch portion in the reference direction;

a sewing control portion configured to terminate the sewing of the stitch portion in a case where it is determined, based on the amount of movement that has been computed by the computation portion, that a length that has been sewn in the reference direction of the stitch portion is not less than the reference length that was acquired by the acquisition portion: and a presser bar to which a presser that is to be used when a buttonhole stitch is sewn is detachably attachable, the presser including a support portion detachably attachable to the presser bar and a presser portion configured to press on at least a portion of the sewing object and supported by the support portion such that the presser portion is movable together with the sewing object, wherein a plurality of the markers are provided on the presser portion, and an interval between the plurality of markers in the reference direction is shorter than a length in the reference direction of an image capture area of the image capture portion.

2. The sewing machine according to claim 1, wherein the stitch set is a buttonhole stitch, the buttonhole stitch includes, as the stitch portion, a whipstitch portion that is to be formed in a long direction of the buttonhole stitch, the acquisition portion acquires, as the reference length, a length of the whipstitch portion in the long direction, the specified range is set at an ending point side of the whipstitch portion, and the sewing control portion terminates the sewing of the whipstitch portion in a case where it is determined, based on the amount of movement that has been computed by the computation portion, that a length that has been sewn in the long direction of the whipstitch portion is not less than the reference length that was acquired by the acquisition portion.

3. The sewing machine according to claim 1, wherein the stitch set is a buttonhole stitch, the buttonhole stitch includes, as the stitch portion, a first whipstitch portion and a second whipstitch portion that are to be formed in a long direction of the buttonhole stitch, the acquisition portion acquires, as the reference length, lengths of the first whipstitch portion and the second whipstitch portion in the long direction, the specified range include a first range that is set at an ending point side of the first whipstitch portion and a second range that is set at an ending point side of the second whipstitch portion, and the sewing control portion terminates the sewing of a current whipstitch portion in a case where it is determined, based on the amount of movement that has been computed by the computation portion, that a length that has been sewn in the long direction of the current whipstitch portion is not less than the reference length that was acquired by the acquisition portion, the current whipstitch portion being one of the first whipstitch portion and the second whipstitch portion that is currently being sewn.

4. The sewing machine according to claim 1, wherein the computation portion computes the amount of movement based on at least an image of an area that is a part of the image that is described by the image data, the area being specified based on an initial position of the marker and on the amount of movement.

5. A non-transitory computer-readable medium storing a control program executable on a sewing machine, the program comprising instructions that cause a computer of the sewing machine to perform steps, the steps comprising:

acquiring a reference length that is a length of a stitch portion in a reference direction, the stitch portion being at least one part of a stitch set that is to be sewn on a sewing object;

generating image data by image capture of one of the sewing object and at least one marker that is moved together with the sewing object;

computing an amount of movement of one of the sewing object and the at least one marker, based on at least the image data;

setting a revolution speed of a sewing machine motor to not greater than a specified value in a case where it is determined, based on the amount of movement, that sewing is being performed in a specified range that has been set at an opposite side of the stitch portion from a starting point of the stitch portion in the reference direction, the sewing machine motor driving a needle bar up and down;

terminating the sewing of the stitch portion in a case where it is determined, based on the amount of movement, that a length that has been sewn in the reference direction of the stitch portion is not less than the reference length; and detachably attaching a presser to a presser bar, the presser is to be used when a buttonhole stitch is sewn, the presser including a support portion detachably attachable to the presser bar and a presser portion configured to press on at least a portion of the sewing object and supported by the support portion such that the presser portion is movable together with the sewing object, wherein a plurality of the markers are provided on the presser portion, and an interval between the plurality of markers in the reference direction is shorter than a length in the reference direction of an image capture area of the image capture portion.

6. The non-transitory computer-readable medium according to claim 5, wherein the stitch set is a buttonhole stitch, the buttonhole stitch includes, as the stitch portion, a whipstitch portion that is to be formed in a long direction of the buttonhole stitch, a length of the whipstitch portion in the long direction is acquired as the reference length, the specified range is set at an ending point side of the whipstitch portion, and the sewing of the whipstitch portion is terminated in a case where it is determined, based on the amount of movement, that a length that has been sewn in the long direction of the whipstitch portion is not less than the reference length.

7. The non-transitory computer-readable medium according to claim 5, wherein the stitch set is a buttonhole stitch, the buttonhole stitch includes, as the stitch portion, a first whipstitch portion and a second whipstitch portion that are to be formed in a long direction of the buttonhole stitch, lengths of the first whipstitch portion and the second whipstitch portion in the long direction are acquired as the reference length, the specified range include a first range that is set at an ending point side of the first whipstitch portion and a second range that is set at an ending point side of the second whipstitch portion, and the sewing of a current whipstitch portion is terminated in a case where it is determined, based on the amount of movement, that a length that has been sewn in the long direction of the current whipstitch portion is not less than the reference length, the current whipstitch portion being one of the first whipstitch portion and the second whipstitch portion that is currently being sewn.

8. The non-transitory computer-readable medium according to claim 5, wherein the amount of movement is computed based on at least an image of an area that is a part of the image that is described by the image data, the area being specified based on an initial position of the marker and on the amount of movement.

* * * * *